United States Patent [19]

Voelz et al.

[11] Patent Number: 4,690,228

[45] Date of Patent: Sep. 1, 1987

[54] CHANGEOVER BIT FOR EXTENDED LIFE, VARIED FORMATIONS AND STEADY WEAR

[75] Inventors: Dieter Voelz, Burgwedel, Fed. Rep. of Germany; Roland Illerhaus, Salt Lake City, Utah

[73] Assignee: Eastman Christensen Company, Salt Lake City, Utah

[21] Appl. No.: 839,415

[22] Filed: Mar. 14, 1986

[51] Int. Cl.[4] ..... E21B 10/20; E21B 10/62; E21B 44/00

[52] U.S. Cl. ..... 175/24; 175/39; 175/342; 175/379; 175/382

[58] Field of Search ..... 175/39, 51, 24, 57, 175/237, 331, 336, 342, 353, 379, 381, 383, 382, 341, 327, 315

[56] References Cited

U.S. PATENT DOCUMENTS

| | | | |
|---|---|---|---|
| 1,029,491 | 6/1912 | Cortinas | 175/379 |
| 1,716,741 | 6/1929 | Schwafel | 175/383 |
| 2,275,832 | 3/1942 | Zublin | 175/342 |
| 3,847,236 | 11/1974 | Coalson | 175/383 |
| 3,862,665 | 1/1975 | Wallace | 175/379 |
| 4,386,669 | 6/1983 | Evans | 175/381 |

FOREIGN PATENT DOCUMENTS

| | | | |
|---|---|---|---|
| 0130456 | 3/1960 | U.S.S.R. | 175/379 |
| 0403838 | 3/1974 | U.S.S.R. | 175/379 |

*Primary Examiner*—Stephen J. Novosad
*Assistant Examiner*—Bruce M. Kisliuk
*Attorney, Agent, or Firm*—Beehler, Pavitt, Siegemund, Jagger, Martella & Dawes

[57] ABSTRACT

A roller cone bit may be used as a rotating drag bit by treating the roller cones as carriers for a plurality of distinguishable types of drag cutters. The roller cones are each coupled to a mechanism which selectively allows rotation of the roller cones. The roller cones are otherwise fixed and as the bit is rotated, the drag cutters are brought into engagement with the rock. However, where the roller cones are selectively allowed to rotate, rotation of the drag bit rotates the roller cones to bring a second set of drag cutters into a configuration for cutting the rock formation. A mechanism then selectively locks the roller cones to prevent further rotation, keeping the second set of drag cutters fixed in place. By selectively permitting and preventing rotation of the roller cones, a plurality of sets of drag cutters can be brought into a configuration for cutting the rock. Such a drag bit may be employed to bring drag cutters selectively into play to cut different types of rock formation, or to present renewed cutters after an initial set of cutters have been worn by a predetermined degree. Furthermore, rotation of the roller cones may be slowed by application of a drag to each roller cone. The drag cutters on each roller cone will be sequentially brought into a cutting configuration with respect to the rock and wear will be evenly distributed among the drag cutters.

21 Claims, 9 Drawing Figures

CHANGEOVER BIT FOR EXTENDED LIFE, VARIED FORMATIONS AND STEADY WEAR

BACKGROUND OF THE INVENTION

1. Field of the Invention

The invention relates to the field of earth boring tools and in particular to drag bits in which a plurality of cutters are sequentially exposed and used to cut the rock formation.

2. Description of the Prior Art

The lifetime and ability of a rotating drag bit used in mining or petroleum applications is invariably limited by the durability of the type of rock cutting element that can be brought to bear for cutting the rock. The bit wears out and ceases to cut because the cutting elements wear out or lose their cutting edges. The bit and the drill string must then be tripped to the well's surface and a new bit installed, followed by a return trip of the drill string downhole. The periodic need to replace worn drill bits significantly adds to the cost of drilling operations.

Furthermore, there is presently no universal cutting element which is capable of cutting every kind of rock formation which can be encountered. Various styles of cutting elements and drag bits are optimized to cut various types of rock formations. Therefore, one bit may be efficient in soft gummy formations, but is of very little utility in hard abrasive formations. Other designs of bits would cut well within hard abrasive formations, yet ball up and fail to cut efficiently in soft formations. In still other applications the formation is stratified so that layers of hard and soft rock are alternated. Generally, when a radically different type of rock formation is encountered downhole and the bit ceases to effectively cut, it still must be retrieved to the well's surface and exchanged for a bit suitable for the rock formation which is encountered even though the previously installed bit is not worn out. This substitution also significantly contributes to the cost of drilling operations.

In an attempt to solve these problems, the prior art has devised a number of different bit designs. For example, Cortinas, "Drill," U.S. Pat. No. 1,029,491 (1912) shows a bit in FIG. 5 of that patent having a plurality of drag cutters or blades 17 on its lower end. Wedge-shaped stops 26 are disposed against the unexposed blades to lock the blades in position. Stops 26 in turn are each coupled to a piston 23 and 24. The drill is operated like a conventional drag bit until the lowermost exposed blades are worn away. The drill string and drill are then pulled upwardly within the bore hole and allowed to drop sharply against the end of the rock formation. After being dropped, the drill is rotated to cause bits 16 and 18 to rotate and lift wedge-shaped stops 25 and 26. The result of the rotation will present a sharp blade in each bit position at which point stops 25 and 26 will then be urged by springs 31 into a locked position to prevent reverse rotation during the normal drilling operations.

While showing a means for rotating a new set of cutting elements into operative position, Cortinas illustrates a bit design which relies upon a jarring impulse for operation and is therefore unreliable and furthermore has a limited torque load carrying capability.

Coalson, "Drill Bit," U.S. Pat. No. 3,847,236 (1974) shows a double ended drill bit with two sets of roller cones. After one drill bit becomes dull, a carriage is rotated to expose an upper bit to the bottom of the bore hole. A carriage is rotated to expose the upper bit to the bottom of the bore hole. The carriage is rotated by raising the bit housing in the bore hole in order to provide a space above the bottom of the bored hole to allow rotation of the carriage. Fluid pressure is then increased within the tool and acts upon a hydraulic piston to place the tool in a configuration where the carriage can be rotated. A spring motor is then provided for rotating the carriage to orient the new roller cone bit toward the rock formation.

Coalson, however, fails to show any means for presenting new cutting elements on different segments of the same cone. Furthermore, Coalson is a roller cone bit which cuts by a crushing mechanism as opposed to the shearing mechanism employed in drag bits.

Hildebrandt, "Combination Drill Bit," U.S. Pat. No. 3,066,749 (1962) describes an extensible cutter blade mounted within the body of the bit. The extensible blades are used when cutting through soft formations and are automatically advanced with respect to the body of the bit to continuously present a fresh cutting surface to compensate for wear. Otherwise cutting action is effectuated through a pair of conventional roller cones. The extensible blade can be selectively brought into operation or retracted therefrom.

However, in Hildebrandt the mechanism for extending the blade in soft formations is independent of the roller cone cutters and presents an unbalanced cutting face on the bit.

Evans, "Drill Bit With Yielding Support And Force Applying Structure For Abrasion Cutting Elements," U.S. Pat. No. 4,386,669 (1983) illustrates the prior art use of different types of cutting elements on the same bit. However, Evans does not show the use of such cutters in contact with the rock formation as the function of the need of the user or of the hardness of the formation which is being cut. In FIG. 3, for example, of Evans, Stratapax cutters 94 are used as drag cutters in combinations with a compression cutter 76. The FIG. 4 of Evans, abrasion cutters 94 are used to cut the gauge while compression cutters 76 on roller cones are provided for primary cutting.

However, Evans fails to show any type of mechanism whereby one type of cutter can be selectively withdrawn and replaced by another.

Demo, "Rotary Shock Wave Drill Bit," U.S. Pat. No. 3,250,337 (1966) shows a bit wherein cutting members 24 are rotated at approximately twice the angular velocity of bit 11. Rotation of cutting member 24 is synchronized by an interlocking timer disk 53. Although Demo shows a drill bit with roller cones that are used in a manner, at least in part, to cut through shearing, there is only a single type of cutter on Demo, and no means for selectively bringing a distinguishable type of cutter into play and maintaining it in exclusive cutting engagement with the rock formation.

What is needed is a simple and rugged mechanism capable of withstanding the torque loads commonly encountered in contemporary drilling operations, and which includes a means for selectively bringing into play distinguishable sets of cutters so that the lifetime of the bit is extended, or so that the number of type of rock formation which can be efficiently cut is increased.

BRIEF SUMMARY OF THE INVENTION

The invention is a drag bit comprising a bit body, at least one carrier rotatably coupled to the bit body, a plurality of cutting elements disposed on the carrier, and a mechanism for selectively rotating the carrier to selectively dispose the cutting elements into an operative configuration. As a result cutting properties of the drag bit are selectively altered.

In one embodiment, the mechanism for selectively rotating the carrier rotates the carrier in response to an operator initiated action. In another embodiment the mechanism for selectively rotating the carrier automatically rotates the carrier upon a predetermined degree of wear of selected ones of the cutting elements disposed on the carrier.

The mechanism for automatically selectively rotating the carrier comprises a gear engaged with the carrier. The gear is coupled to and is moveable with respect to the bit body. A second mechanism selectively permits movement of the gear relative to the bit body thereby in turn permitting selective rotation of the carrier.

The second mechanism for selectively permitting rotation of the gear relative to the bit body comprises a plurality of stops defined into the gear, and a corresponding plurality of selectively locked wedge elements. The wedge elements are arranged and configured to abut the corresponding stops defined in the gear. The wedge elements prevent movement of the gear when locked in abutment with the corresponding stop. The wedge elements are also selectively unlockable to permit movement of the gear. The second mechanism also includes a third mechanism for unlocking the wedge elements.

The third mechanism for unlocking the wedge elements comprises a hydraulic piston coupled to each of the wedge elements and a corresponding cylinder. The hydraulic piston is telescopically disposed in the hydraulically filled corresponding cylinder, and a corresponding conduit communicates the hydraulically filled cylinder to a terminus at a predetermined position adjacent the cutting elements on the carrier. The terminus seals the conduit thereby retaining fluid within the cylinder and maintaining the wedge element in a locked configuration. The terminus is worn away after a predetermined amount of wear of the cutting elements has occurred and exposes the terminus to wear against the rock formation, thereby opening the terminus and permitting escape of hydraulic fluid from the cylinder and thereby unlocking the wedge from the gear.

In one embodiment the invention further comprises a plurality of carriers and the mechanism for selectively rotating the carrier comprises a selectively actuatable piston within the bit body. The piston has an aperture defined therethrough to normally permit flow of hydraulic fluid through the bit body and aperture. The aperture is selectively closable thereby causing hydraulic pressure to be exerted against the piston. A plurality of push rods is coupled to the piston, and a corresponding plurality of cammed elements is coupled to the plurality of carriers and rotatable therewith. The cammed elements each include at least one cam surface for engagement with the corresponding one of the push rods whereby movement of the corresponding one of the push rods rotates the cammed element and hence the corresponding carrier through a predetermined angular degree of rotation.

The cammed element is rotatable in only one direction to thereby permit replacement of a first set of cutting elements by a second set of the cutting elements.

A conduit is disposed through the carrier to a terminus adjacent selected ones of the cutting elements. The conduit fluidically communicates with a primary hydraulic flow through the bit body. The terminus is selectively opened after a predetermined degree of wear has occurred with respect to the corresponding cutting elements on the carrier adjustment to the terminus of the conduit. Hydraulic pressure is relieved through the conduit from the bit body, and the relief of pressure is observable by the operator.

In the preferred embodiment the carrier is conically shaped and is divided into a plurality of sectorial exterior areas. Each area is provided with a corresponding distinguishable type of cutting element. Each type of cutting element is optimized for cutting a corresponding distinguishable type of rock formation.

In another embodiment the mechanism for selectively rotating the carrier comprises a gear wheel engaging the carrier. The gear wheel is selectively locked and unlocked to permit rotation of the gear wheel and thus the carrier by the operator initiated action.

In yet another embodiment the mechanism for selectively rotating the carrier rotates the carrier at a reduced rate thereby dragging the cutting elements against the rock formation. The mechanism for selectively rotating the carrier comprises a mechanism for generating a stepwise drag on rotation of the carrier. Alternatively the mechanism for selectively rotating the carrier comprises a mechanism for continuously applying a rotational drag to the carrier.

Where the mechanism applies a stepwise drag to the carrier, the mechanism comprises a plurality of dash pots disposed within the carrier and a fixed pivot pin disposed within the carrier. The carrier rotates about the fixed pivot pin. The fixed pivot pin is fixed to the bit body. The pivot pin comprises a plurality of cammed portions. The cammed portions selectively engage the dash pots during selected rotational segments of the carrier about the pivot pin.

The invention can also be characterized as an improvement in a roller cone bit for cutting a rock formation. The roller cone bit comprises a plurality of roller cones. The improvement comprises a plurality of sets of drag cutters disposed on each one of the plurality of roller cones; and a mechanism for selectively preventing rotation of each roller cone to present selected ones of the sets of drag cutters to the rock formation for cutting. As a result cutting performance of the roller cone bit as a drag bit is selectively alterable.

The mechanism for selectively preventing rotation of the roller cones comprises a mechanism for first permitting rotation of the roller cone through a predetermined angular degree to present a second one of the plurality of the drag cutters to the rock formation in an operative cutting configuration, and a mechanism for subsequently preventing further rotation of the roller cone.

The invention further comprises a mechanism for selectively initiating operation of the mechanism for first permitting rotation and selectively initiating the mechanism for subsequently preventing rotation of the roller cone after a predetermined degree of wear of a corresponded selected one of the plurality of set of drag cutters has occurred.

The mechanism for selectively initiating operation, initiates the operation in response to operator action.

The mechanism for initiating operation generates a signal interpretable by the well operator. The signal is generated upon occurrence of the predetermined degree of wear.

In one embodiment the mechanism for selectively initiating operation initiates the operation automatically without operator intervention upon occurrence of the predetermined degree of wear.

The invention can still further be characterized as a method for selectively presenting ones of a plurality of sets of drag cutters for cutting into a rock formation. The drag cutters are disposed on roller cones of a roller cone bit. The method comprises the steps of rotating the roller cone bit, and selectively preventing rotation of each roller cone of the bit to dispose selected sets of the plurality of drag cutters to the rock formation for cutting. The roller cones are otherwise free to rotate with the rotation of the roller cone.

The invention can be alternatively characterized as a method for selectively presenting ones of a plurality of sets of drag cutters for cutting into a rock formation. The drag cutters are disposed on roller cones of a roller cone bit. The method comprises the steps of rotating the roller cone bit, and selectively allowing rotation of each roller cone to operatively present selected ones of the plurality of sets of drag cutters to the rock formation for cutting.

Figure 1:
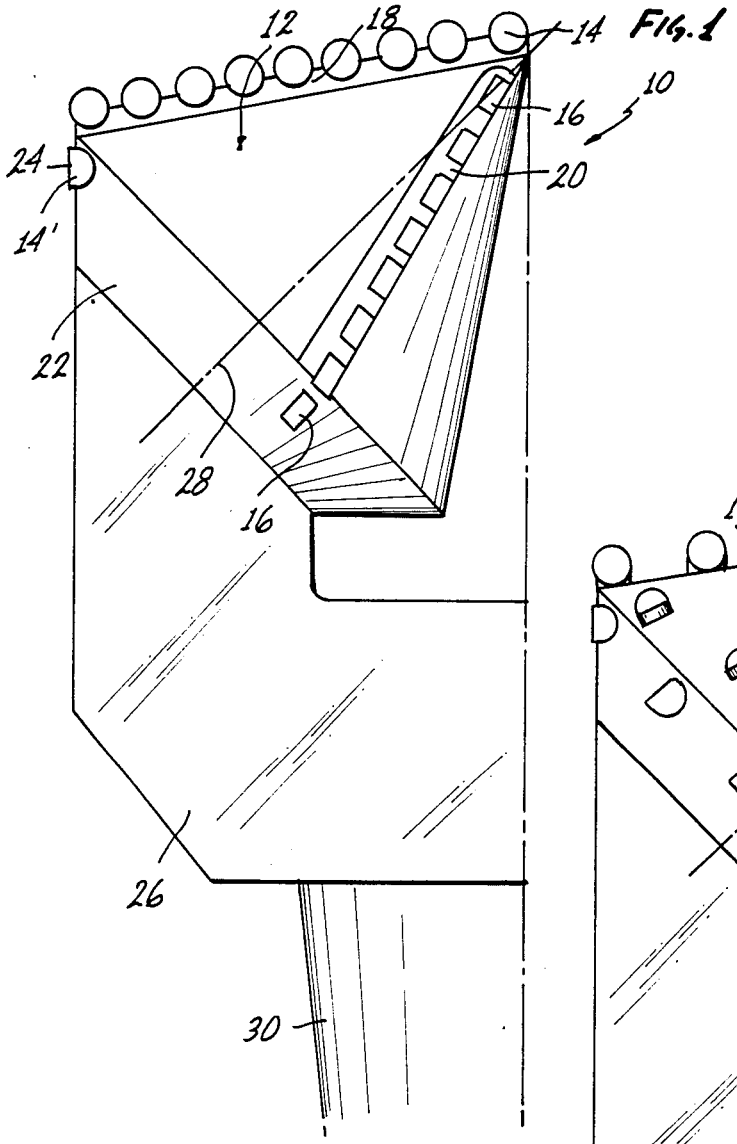
FIG. 1 is a simplified diagrammatic view of a drag bit incorporating a conical shaped carrier for a plurality of distinguishable types of cutting elements.

The invention and its various embodiments may better be understood by now turning to following description.

DETAILED DESCRIPTION OF THE PREFERRED EMBODIMENTS

A roller cone bit may be used as a rotating drag bit by treating the roller cones as carriers for a plurality of distinguishable types of drag cutters. The roller cones are each coupled to a mechanism which selectively allows rotation of the roller cones. The roller cones are otherwise fixed and as the bit is rotated, the drag cutters are brought into operative engagement with the rock formation. However, where the roller cones are selectively allowed to rotate, rotation of the drag bit rotates the roller cones to thereby bring a second set of drag cutters into an operative configuration for cutting the rock formation. A mechanism then selectively locks the roller cones to prevent further rotation, thereby keeping the second set of drag cutters fixed in place. By selectively permitting rotation and preventing rotation of the roller cones, a plurality of sets of drag cutters can be brought into an operative configuration for cutting the rock formation. Therefore, such a drag bit may be employed to bring drag cutters selectively into play to cut different types of rock formation, or to present renewed cutters after an initial set of cutters have been worn by a predetermined degree. Furthermore, rotation of the roller cones may be slowed from that normally expected by application of a drag to each roller cone. The drag cutters on each roller cone will thereby be sequentially brought into an operative cutting configuration with respect to the rock formation and where will be evenly distributed among all the drag cutters disposed on each roller cone.

The invention is a rotating diamond drag bit in which wings or ribs are provided as cutting elements, which ribs are selectively rotated into an operative configuration. After the cutting elements on a rib have been worn down, a new ring or rib is rotated into place and the operation begun anew. In one of the illustrated embodiments, three such ribs are provided. Each rib contains a plurality of diamond cutting elements which are disposed on a conically shaped carrier.

In a first embodiment, the rotation of the carrier is activated by dropping a ball which seats against a piston. The piston is thereby depressed and pushes a rod forward. The rod mates against an indentation in the carrier thereby rotating it. The rotation is sufficient to bring the next blade of cutting elements into a cutting position. Reverse rotation is prevented by a spring-loaded locking pin.

In a second embodiment a spring-loaded bar is disposed into a groove defined in an axle of the conical shaped carrier. The axis of the bar is parallel to the axis of the conical carrier axle. Again, a rod is forced by hydraulic fluid to advance the piston. The piston turns the axle of the carrier. As the carrier rotates, the bar rotates and ultimately will lie flush within a half-circle of indentation in the stationary axle of the carrier. After the carrier has rotated, the spring-loaded bar then snaps back into a half-cylindrical indentation defined in the interior of the carrier's body. Reverse rotation is prohibited by the jamming of the bar against corresponding indentations formed in the body of the carrier.

In another embodiment of the invention a bypass duct is provided through the drill. The bypass duct is normally sealed. However, after the cutting elements have been sufficiently worn away, the sealing of the bypass duct is also worn away. Once the bypass duct has opened, a drop in hydraulic pressure is sensed at the well's surface. At this point the operator inserts the drop ball which activates the rotation of the conical carrier as described above.

In yet another embodiment, an automatic means is provided for changing or bringing a distinguishable type of cutting elements into play. The carrier body is driven by a gear. The gear is locked into place by a wedge-shaped stop. The wedge-shaped stop is connected to a piston forming one part of hydraulic cylinder. Hydraulic fluid within the drill string is communicated through tubing to a terminus on the cutting surface of the carrier. After a predetermined amount of the cutting element has been worn away, the sealed termination tubing is also worn away thereby opening the tube. As soon as the tubing is opened, the piston is depressed, carrying the wedge-shaped stop. The gear is now free to rotate to the next stop position to expose an additional plurality of new cutting elements.

In yet another embodiment a plurality of cutters are provided on a cone-shaped carrier and the carrier is allowed to slowly rotate. A mechanism, incorporated within the carrier, creates a drag on the carrier which slows rotation of the carrier either in a stepwise fashion or in a continuous fashion. In particular, a continuous drag system is illustrated wherein hydraulic dash pots ride against a stationary cammed axis which is coupled to the axis of the conical carrier. Because of the camming action, rotation of the conical carrier is highly intermittent and approaches a stepwise action. The invention and its various embodiments are better understood by now turning to the depiction of FIG. 1.

FIG. 1 is a simplified side elevational view of a bit, generally denoted by reference numeral 10 showing a carrier, generally denoted by reference numeral 12, upon which a plurality of cutting elements 14 and 16 have been disposed. Cutting elements 14 are disposed on a first rib 18, while second plurality of cutting elements 16 are disposed on a second rib 20. Additional cutting elements may also be included on conically-shaped carrier 12 although only two such pluralities of cutting elements are depicted in FIG. 1. The basal portion 22 of carrier 12 is beveled to form a frustoconical shape. Basal portion 22 similarly is provided with gage cutters 16. As depicted in FIG. 1, plurality of cutters 14 are presented during cutting operation to the bottom of the borehole. The bevel of basal portion 22 is such that the surface of bevel 22 presents cutters 14 on beveled surface 22 in a generally vertical direction so that cutters on bevel 22 act as gage cutters. For example, in the illustrated embodiment, cutters 14 are diagrammatically depicted as circles and may be fabricated from conventional diamond Stratapax tables which are manufactured by General Electric Company under that trademark. The Stratapax cutter 14' on beveled surface 22 may be appropriately machined or formed to present a flattened vertical surface 24 for gauge protection. Similarly, cutters 16 may be fabricated from a plurality of any one of a number of distinguishable types of diamond cutters now known or as may be later devised in the art. For example, diamond Ballaset cutters as manufactured under that trademark by Norton Christensen, Inc. of Salt Lake City can be employed for cutters 16. Therefore, cutters 16 may be adapted for medium-to-hard formations, while Stratapax cutters 14 may be sized and adapted by material composition for efficient cutting in soft formations.

Carrier 12 is journaled to an arm 26 by means of a fixed axle or shaft. Therefore, carrier 12 selectively rotates about carrier axis 28 as described below. Arm 26 in turn is connected to or integrally formed with a conventional bit pin connector 30 for coupling to a drill string.

FIG. 1 shows a single one of such carriers 12 although a multiple may be provided on the corresponding plurality of arms 26 radiating in a spider-like configuration from pin connector 30. For example, three such conical carriers 12 could be equally azimuthly spaced about the longitudinal axis of pin 30 to form a balanced drill bit face.

Although carrier 12 is rotatable as described in further detail below, carrier 12 is also selectively locked in position so that a single row of cutters 14 or 16 are selectively disposed toward the rock formation at any one time. Therefore, the bit of FIG. 1 is a drag bit which cuts primarily through a shearing action and not by means of crushing compression.

Figure 2:
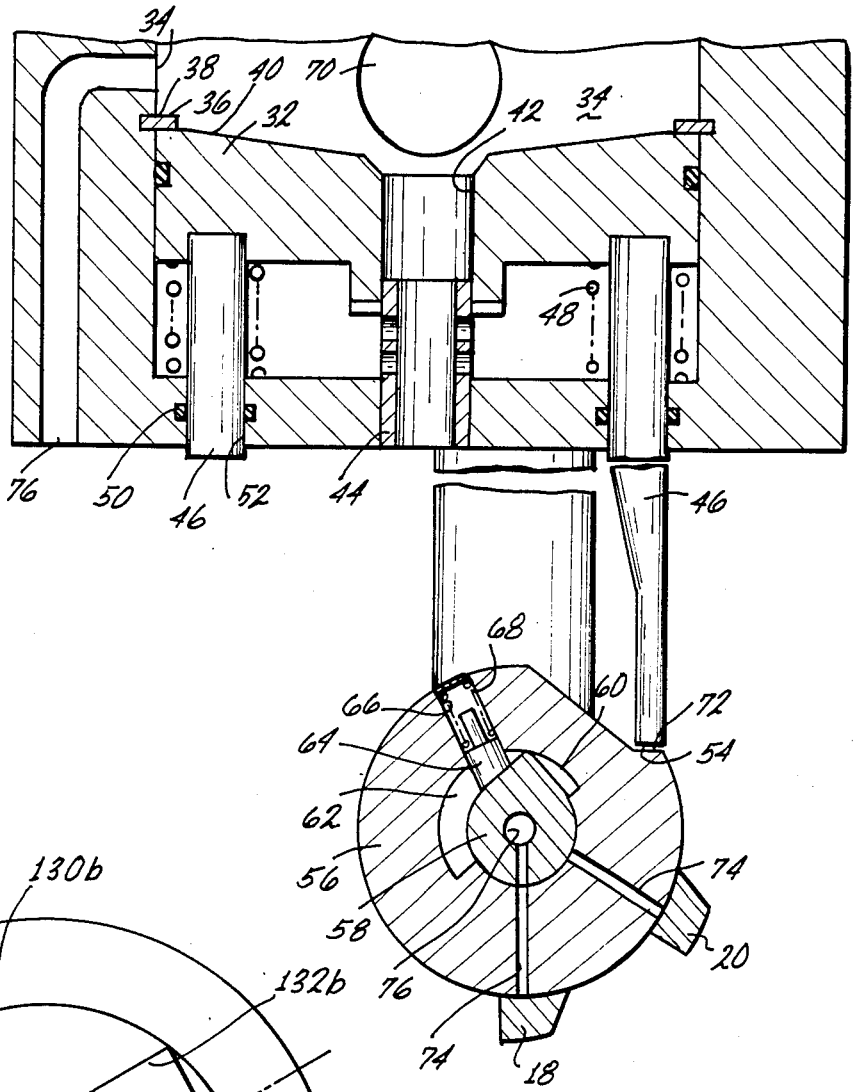
FIG. 2 is a simplified cross sectional view of a portion of a mechanism contained within the carrier of FIG. 1.

Turn now to FIG. 2 wherein a first embodiment is illustrated to clarify the means by which carrier 12 of FIG. 1 is selectively rotated and locked into place. A piston 32 is provided within the body of bit 10 in a conventional manner within a piston cavity 34. Piston 32 is retained in piston cavity 34 by a split retaining ring 36 disposed in a corresponding and mating annular groove 38 defined into cavity 34. Piston 32 is similarly sealed against the inside surface of cavity 34 by means of a conventional O-ring and groove combination, generally denoted by reference numeral 40. Piston 32 is thereby free to move in a sealed relationship in a longitudinal direction within cavity 34. Normally, fluid within cavity 34 enters central aperture 42 and flows through piston 32 through conduit 44 which communicates with aperture 42 and thence to the bit face of bit 10.

Coupled to piston 32 is a plurality of push-rods 46 of which two are depicted in the simplified cross-sectional view of FIG. 2. Each rod 46 is spring-biased by means of a compression spring 48 disposed annularly about rod 46 and between piston 42 and an interior bottom end surface of cavity 34. Rods 48 are also sealed by means of a conventional O-ring and groove combination 50 disposed within the body of bit 10 within a through-hole 52 defined through the body of the bit and through which rods 46 are displaceable.

In FIG. 2 the distal end 54 of one of rods 46 is diagrammatically depicted in engagement with a rotatable cam 56 which is coupled by conventional means (not shown) to carrier 12 of FIG. 1. Cam 56 is rotatable about a fixed pivot shaft 58 which is fixed to the body of bit 10. Pivot shaft 58 is generally circular cylindrical shaft with the exception of a radially extending cam member 60. A semicylindrical cavity 62 is defined within cam 56 into which cam member 60 of shaft 58 extends. Cam member 60 prevents rotation of cam 56 in a predetermined direction. For example, in the depiction of FIG. 2, cam 56 is prevented by cam portion 60 from rotating in a counter-clockwise. direction. A telescopic locking pin 64 is dispose within a cylindrical bore 66 radially defined through cam 56 so that pin 64 is free to move in a radial direction through cam 56 with respect to pivot shaft 58. Pin 64 is spring-loaded by means of a conventional compression spring 68 so that it is constantly urged against the surface of a stationary pivot shaft 58. Pin 64 is, however, carried by cam 56 which is rotatable about pivot shaft 58 in a clockwise sense as shown in the depiction of FIG. 2.

When a ball 70 is dropped within the drill string it will ultimately come to rest against piston 32 and will seal aperture 42. Hydraulic pressure then builds up on piston 32 longitudinally disposing it toward the end surface of piston cavity 34. Rods 46 are longitudinally advanced against the resistance of compression springs 48. As rod 46 advances, it mates with a corresponding shoulder 72 defined in the exterior surface of cam 56. Cam 56 is thus caused to rotate in a clockwise sense as depicted in FIG. 2. As cam 56 rotates, carrier 12 similarly rotates moving rib 18 from the exposed engaged position and replacing it with rib 20. Identical movement occurs for each of the plurality of carriers disposed on bit 10. Pin 64 frictional engages cam 56 with pivot post 58 to prevent rotation of cam 56 and carrier 12 after movement due to vibration or other forces applied to carrier 12.

Disposed into ribs 18 and 20 and through cam 56 are fluidic ducts 74 which are closed off at their end within ribs 18 and 20, but which are freely open to and communicating with a axial conduit 76 defined within pivot shaft 58. Axial conduit 76 in turn communicates with cavity 34 by appropriate ducting (not shown) within the body of bit 10. Therefore as the cutting elements within rib 18, for example, are worn down, ultimately its corresponding conduit 74 will be worn away and opened. Upon the opening of conduit 74, fluidic pressure will be vented through conduits 74, 76 from cavity 34. A pressure drop will be observable at the well's surface indicating to the well operator a predetermined amount of wear upon rib 18. Thereupon the operator will insert drop ball 70 within the drill string to effectuate the rotation of carrier 12 and the positioning of a new tooth carrying rib 20 into position.

Figure 3:
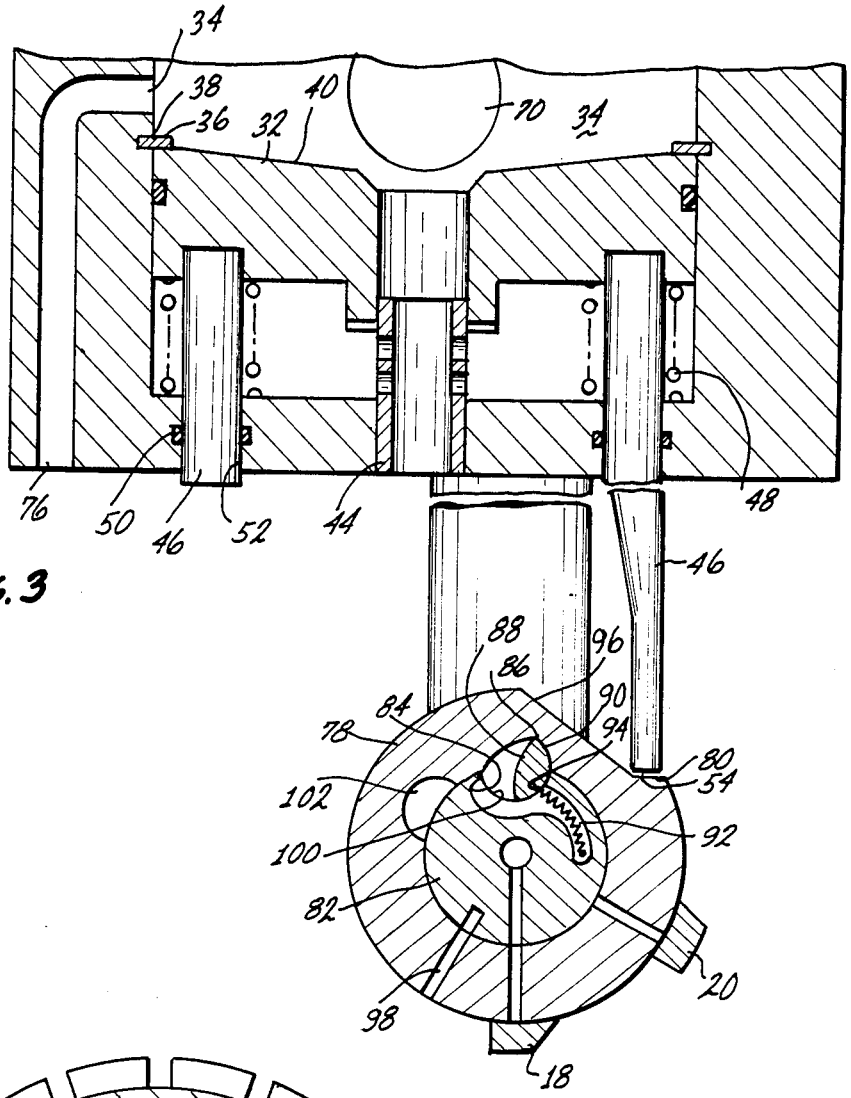
FIG. 3 is a diagrammatic cross sectional view of an alternative mechanism included within the carrier of FIG. 1 for rotating the carrier.

Turn now to an alternative embodiment as depicted in FIG. 3. FIG. 3 is a simplified cross-sectional diagram as previously shown in FIG. 2 with the exception that the mechanism for rotating carrier 10 is distinct. The piston used to rotate carrier 12 is identical to that shown in FIG. 2 and its description will not be repeated with respect to the embodiment of FIG. 3. Therefore, turn your attention specifically to the detailed design of cam portion 78 of carrier 12 as shown in FIG. 3. Cam portion 78 again includes a shoulder 80 against which contacts the distal end 54 of rod 56. Cam portion 78 of the embodiment of FIG. 3 differs from that of FIG. 1 principally in the mechanism used to advance and lock cam portion 78 relative to a fixed pivot post or shaft, which in the embodiment of FIG. 3, is denoted by reference numeral 82. Pivot shaft 82 is fixed to the body of bit 10. An arcuate cavity 84 is defined within fixed pivot shaft 82 in which a spring-loaded moveable cam 86 resides. Cam 86 is a semi-circular cylindrical element having a generally flat or slightly rounded diametrical surface 88 with a large radius of curvature approximately matching that of the inner diameter of cam portion 78, and an opposing semi-circular cylindrical surface 90 of a substantially smaller radius of curvature. The curvature of surface 90 of cam 86 is approximately equal to the curvature of a longitudinal groove or broach 100 defined into pivot shaft 82. Surface 90 of cam 86 is coupled to pivot shaft 82 by means of an extension spring 92. Extension spring 92 has one end attached to fixed pivot shaft 82 and the opposing end attached to an off-center point 94 of cam 86, which thus tends to draw one lateral edge or end of cam 86 inwardly toward pivot shaft 82. Cam 86 is disposed in a cylindrical mating cavity 94. Cavity 94 is defined partially within pivot shaft 82 and partially within cam portion 78 of carrier 12. In the cross-sectional depiction shown in FIG. 3, cavity 94 comprises a sectioned portion 100 of a cylindrical cavity having a diameter or radius of curvature with respect to its curved interior surface matching the curvature of cam 86. Therefore the circular cylindrical surface 90 of cam 86 is free to slide within cavity 94, at least within that portion 100 which has a mating circular surface. The opposing surface of cavity 94 is flat or nearly flattened by a cord section 96 of the otherwise circular cylindrical cavity shape.

As seen in FIG. 3 cam 86 is pulled by extension spring 92 to the right side of cavity 94. Extension spring 92 remains under tension thereby tending to rotate cam 86 within cavity 94. However, cam 86 cannot rotate in a counter-clockwise sense as seen in FIG. 3 due to the juxtaposition of the flat surface section 96 of cavity 94. Counter-clockwise motion of cam portion 78 relative to fixed pivot shaft 82 is prevented by the jamming of cam 86 within cavity 94. In addition thereto, a shear pin 98 is disposed through cam portion 78 and into fixed pivot shaft 82. Therefore, relative rotation is prohibited unless a predetermined magnitude of torque is applied to cam portion 78. Even if such a predetermined magnitude of torque should be applied to break shear pin 98 and thereby allow relative rotation of cam portion 78 with respect to pivot shaft 82, cam 86 prevents such counter-clockwise rotation as depicted in FIG. 3.

However, when piston 32 is actuated and rods 46 advanced, cam portion 78 of carrier 12 will be rotated in clockwise sense as depicted in FIG. 3. Shear pin 98 will be broken and the clockwise rotation of cam portion 78 is permitted by cam 86. As cam portion 78 continues to rotate in a clockwise direction, cam 86 is eventually turned within the semi-circular portion 100 of cavity 94 and presents its matched curved surface 88 to the opposing inner diameter of cam portion 78 of carrier 12. The radius of curvature of surface portion 88 of free cam 86 approximately matches the curvature of the outer diameter of pivot shaft 82. Therefore, cam 78 continues to rotate until semi-circular cylindrical cavity 102 becomes aligned with free cam 86. At this point, rib 18 is rotated out of cutting engagement and rib 20 has been rotated into an operative position. Cam 86 is therefore freely pulled within a cam broach 102 by means of extension spring 92 which has been extended by the relative rotation of cam 86 within cavity 94. The increased hydraulic pressure and resultant extension of rod 46 prevents any counter-clockwise rotation of cam portion 78 of carrier 12.

Figure 5:
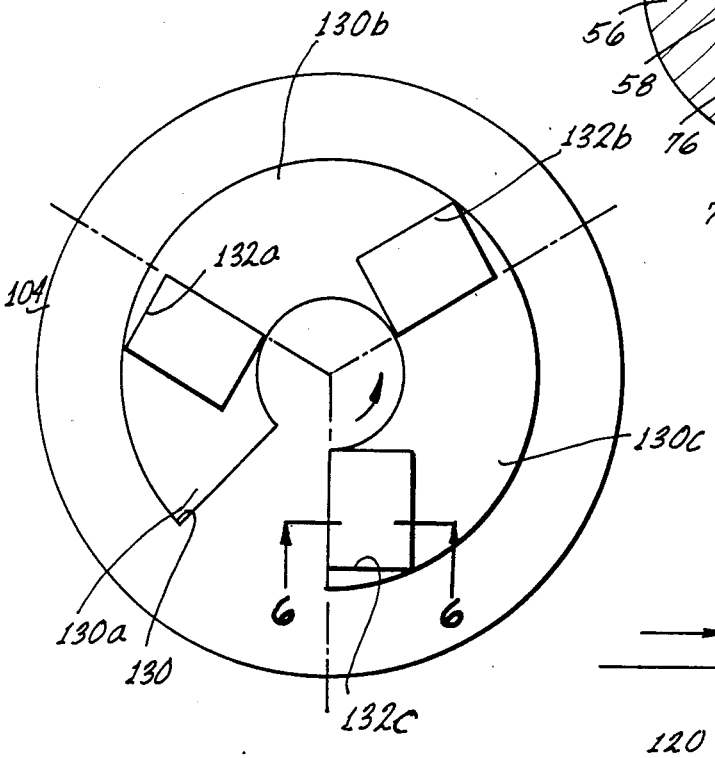
FIG. 5 is a conceptual plan view of a rotational disk as seen through lines 5—5 of FIG. 4.
Figure 6:
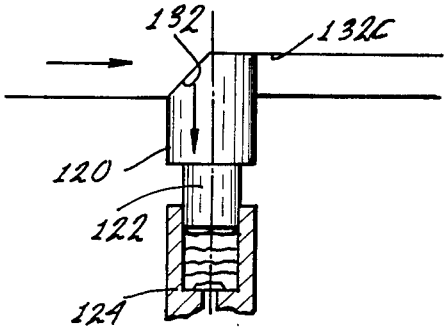
FIG. 6 is a simplified diagrammatic view of a portion of the locking mechanism employed in the embodiment of FIGS. 4 and 5 as seen through lines 6—6 of FIG. 5.
Figure 4:
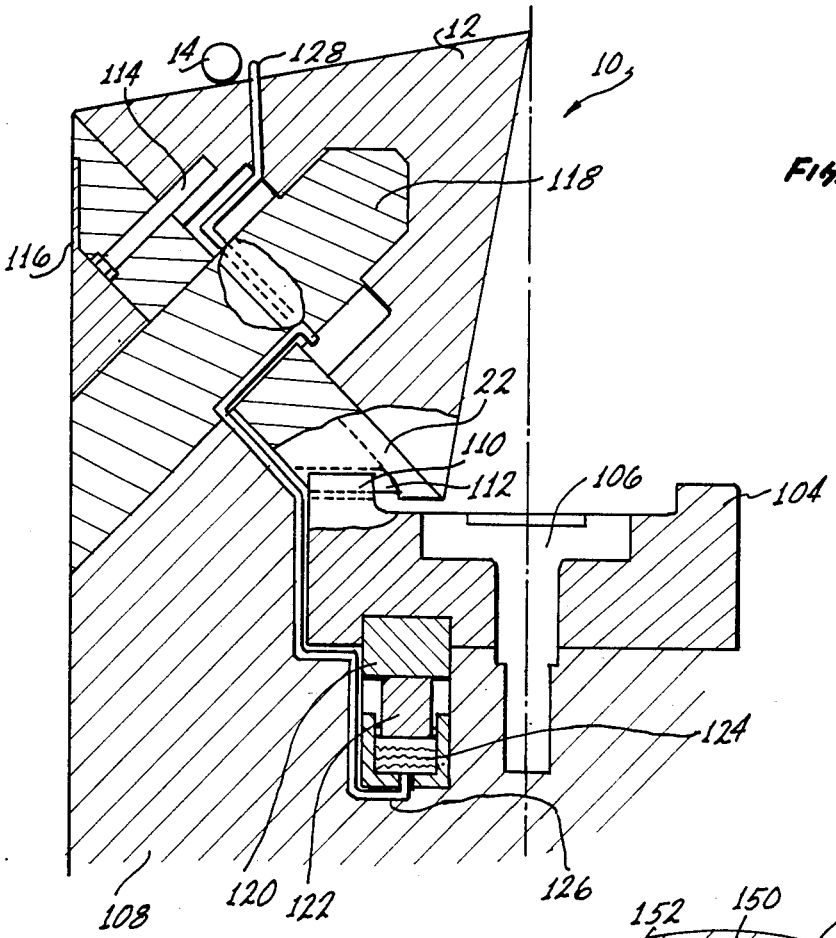
FIG. 4 is a simplified cross sectional view of a third embodiment of the invention.

Turn now to the embodiment of the invention as depicted in FIGS. 4–6. In FIG. 4 drill bit 10 is shown in simplified diagrammatic view. Like elements continue to be referenced by like numerals. In the embodiment of FIGS. 4–6 the push rod and cam action shown in the embodiments of FIGS. 2 and 3 is replaced by controlled rotation of a gear 104. The initiation of rotation of carrier 12 in the embodiments of FIGS. 2 and 3 is initiated by the well operator by means of insertion of drop ball 70 within the drill string. In contrast, the embodiment of FIGS. 4–6 operate automatically to present a new row of cutting elements after the previously used row has been worn away. Gear 104 is freely rotatable about a pivot pin 106 which is threaded to body 108 of bit 10. Gear wheel 104 has a plurality of gear teeth 110 defined on its upper peripheral surface. Gear teeth 110 mate with a corresponding plurality of gear teeth 112 provided in frustoconical section 22 of carrier 12. Typically, frustoconical section 22 is manufactured separately from the conically-shaped carrier 12 and is affixed thereto by a plurality of bolts 114, one of which is depicted in FIG. 4. A curved skirt 116 is coupled to or formed as part of bit body 108 and is disposed on the outside or gage surface of portion 22 of carrier 12 to protect teeth 112. However, in most instances it may be possible that teeth 112 are provided only on a segment of frustoconical portion 22 inasmuch as the degree of rotation of carrier 12 is substantially less than one hundred eighty (180) degrees and in fact may be as little as thirty (30) degrees as suggested by the embodiments of FIGS. 2 and 3.

During drilling, a torque is normally applied to carrier 12 by virtue of the drilling operation and by the reactive drag force applied by the rock formation to teeth 14. Therefore carrier 12 is urged to rotate about fixed pivot shaft 118. Such rotation is prevented, however, by engagement of carrier 12 through frustoconical portion 22 to gear 104. Rotation of gear 104 is prevented by an underlying wedge 120, whose operation and cooperation with gear 104 to selectively prevent its rotation is better described below in connection with FIGS. 5 and 6.

The tendency of carrier 22 to rotate and thus gear 104 to rotate is translated into a downward force against wedge 120 as depicted in FIG. 4. Wedge 120 is coupled to a hydraulic piston 122. Piston 122 is disposed in a sealed relationship with a piston cylinder 124 containing a hydraulic fluid. The contents of cylinder 124 in turn is communicated through a flexible conduit 126, such as a flexible copper or metal tube. Conduit 126 is lead from cylinder 124 into and through carrier 12. End 128 of conduit 126 is normally sealed and terminates at a predetermined location in the vicinity of cutting teeth 14. As cutting teeth 14 are worn away, ultimately end 128 will be placed into contact with the adjacent rock formation. The sealed end of conduit 126 will thus be worn away thereby opening conduit 126. The hydraulic fluid, which is under pressure by virtue of the downward force in piston 122 from wedge 120 is thus released through conduit 126. Piston 122 and wedge 120 thus move longitudinally downward in the depiction of FIG. 4 permitting free rotation of wheel 104. The reactive drag torque at this point rotates carrier 12 thereby presenting the next adjacent rib of cutting teeth into an operative position.

To better understand how the action of wedge 122 operates in conjunction with wheel 104 to selectively permit motion and then relock the motion of carrier 12 turn now to the depictions of FIGS. 5 and 6. FIG. 5 is a simplified diagrammatic view of the underside of wheel 104 as seen through lines 5—5 of FIG. 4. The underside of wheel 104 is provided with a circular groove 130. Within circular groove is a plurality of stepped indentations 132. Each stepped indentation is deeper, as viewed in the depiction of FIG. 5, than the preceding one. For example, the depth of groove 130 in region **130*a* is the deepest region followed by progressively shallower and shallower regions until the region of 130*c* is reached which is the most shallow of all. Consider a cross-sectional view of the coaction of wedge 120 as seen through lines 6—6 of FIG. 5. The upper surface of wedge 120 is disposed against groove 130, and in particular in the illustration of FIG. 6 rides against surface portion 130*c*. Wedge 120 may therefore rotate in a clockwise direction as shown in the depiction of FIG. 5 until wedge 120 is jammed against inclined surface 132. As long as piston 122 is not free to move within cylinder 124, wedge 120 is rigidly held against the stopping action of inclined surface 132. An inclined mating surface is provided in the facing edge of wedge 120 to meet the inclined surface on the bottom of wheel 104. However, once the fluid is drained from cylinder 124, piston 122 is free to move downward and the inclined surface 132 of the bottom of wheel 104 applies a downward force against wedge 120 thereby forcing the fluid out and eventually moving wedge 120 to a position where it is able to clear inclined surface 132 and thereby permitting rotation of wheel 104**.

Clearly, once the respective conduit 126 of cylinder 124 is ruptured, wedge 120 can be longitudinally depressed through the entire length of the stroke of piston 122 within cylinder 124. The stroke of this piston is sufficient to clear each of the wedge-shape stops 132 shown in FIG. 5. Therefore, there is a first piston of the type shown in FIGS. 4 and 6 which is positioned to provide a stopping mechanism against the first inclined surface, namely wedged surface **132*a*. A second and third similar wedge 120 are also provided at heights which clear the preceding wedged surface 132, but are positioned to meet the next subsequent wedged surface 132*b*. For example, three such wedges are provided in a radial alignment as shown in FIGS. 4 and 6. A first one corresponds to surface 132*a*, a second to surface 132*b* and a third to wedged surface 132*c*. A second and third one are positioned at heights which clear wedged surface 132*a* and surface 130*b*. A second piston however will meet and abut second wedged surface 132*b*. The third piston is positioned so as to clear surface 132*b*. Once the second cylinder and piston are then drained, the second wedge is free to be pushed downward and the third piston can be rotated across surface portion 130*c* until it meets and abuts the third wedge 132*c*. Each piston is provided with its corresponding conduit 126 which is appropriately positioned in carrier 12 to the corresponding vane of cutting elements. The conduits corresponding to each piston are wrapped about shaft 118 so that the conduits unwind as carrier 12** rotates and therefore remain intact and unbroken.

When the last rib of cutting teeth is worn away, the corresponding conduit will be opened and wheel 104 free to rotate. At this point there will be no torsional resistance applied to the drill bit which will now freely rotate within the borehole. This difference on the torque on the bit will be a signal to the well operator that all of ribs of the drilling teeth have been sequentially placed in position and worn away. Otherwise, the drilling teeth are automatically changed without the knowledge or interaction in any manner with the well operator.

Figure 7:
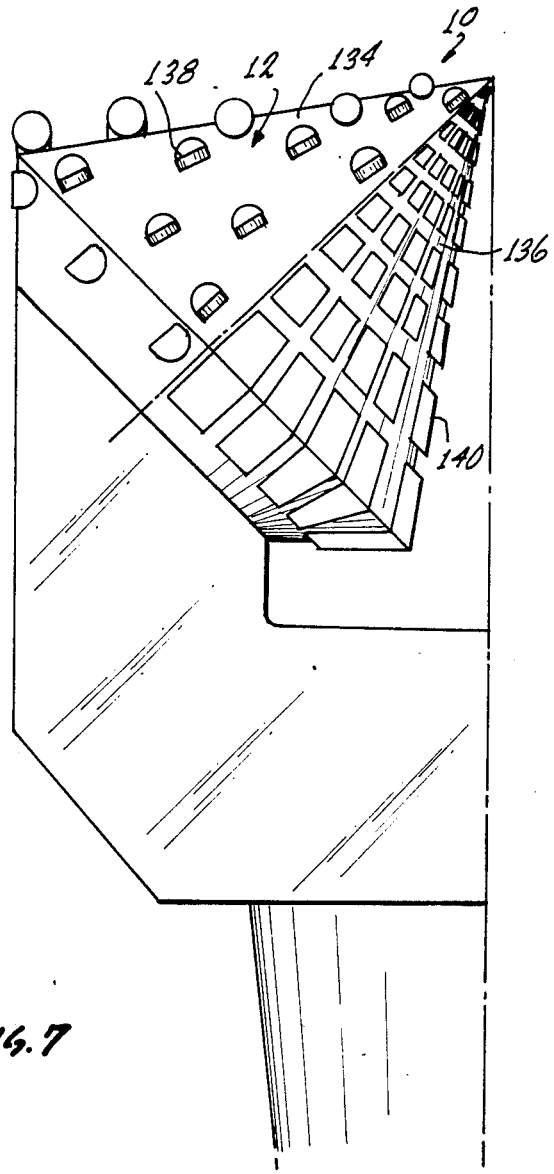
FIG. 7 is a simplified elevational view of yet another embodiment of a portion of a drill bit incorporating the invention.

The embodiment of FIG. 1 was described in connection with a plurality of ribs each bearing a plurality of cutting elements on each rib in the form of a single or at most several linear rows of teeth on carrier 12. Turn now to FIG. 7 where an alternative embodiment of the tooth configuration on carrier 12 of bit 10 is illustrated. In the embodiment of FIG. 7, the exterior surface of carrier 12 is partitioned into an equal number of conical sections of which two are shown in the depiction of FIG. 7, namely a first section 134 and second section 136. A plurality of Stratapax teeth 138, well known to the art, are disposed on stud cutters in a conventional manner on conical section 134 of carrier 12. On section 136, the outer surface of carrier 12 is provided with a plurality of diamond impregnated segments arranged in an array. Carrier 12 may have other sections also provided with other teeth such as surface set diamond cutters, BallaSet Teeth and the like. Stratapax is a trademark of General Electric Co. and refers to non-thermally stable diamond tables affixed to metal slugs which in turn are typically affixed to a steel stud. The stud is then mounted into the drill bit surface. Ballaset cutters is a trademark of Norton Christensen Co., Inc. and refers to thermally stable diamond retained on the surface of the drill bit and exposed above it in a number of tooth configurations, typically employing a triangular prismatic diamond element.

In any case, various surface segments of carrier 12 may be provided with selective types of diamond cutters or other types of cutters now known or later devised which are adapted to specifically cut certain types of rock formations. For example, in the illustrated embodiment of FIG. 7, Stratapax cutters 138 of sector 134 of carrier 12 are particularly efficient in cutting soft formations. On the other hand, impregnated cutters 140 of segment 136 of carrier 12 are well adapted to cutting hard abrasive rock formations.

Therefore, as bit 10 proceeds through stratified layers of rock formation, carrier 12 can be selectively rotated by the well operator control to present an optimal type of cutting element in an operative configuration. In the embodiment of FIG. 7, the Stratapax cutters 138 of sector 134 are shown positioned in the operative cutting configuration.

Selective rotation of carrier 12 in the embodiment of FIG. 7 may be effectuated through a gearing means similar to that previously described in connection with FIGS. 4–6. However, instead of automatically rotating gear wheel 104 by means of selectively and sequentially venting a hydraulic field cylinder, the wedge-shaped stop elements 120 described above may be electromechanically operated from the well surface through solenoids or selectively operated hydraulic pistons. Selective operation of such wedges by solenoids can be effectuated by conventional MWD downhole circuitry well known to the art.

Figure 8:
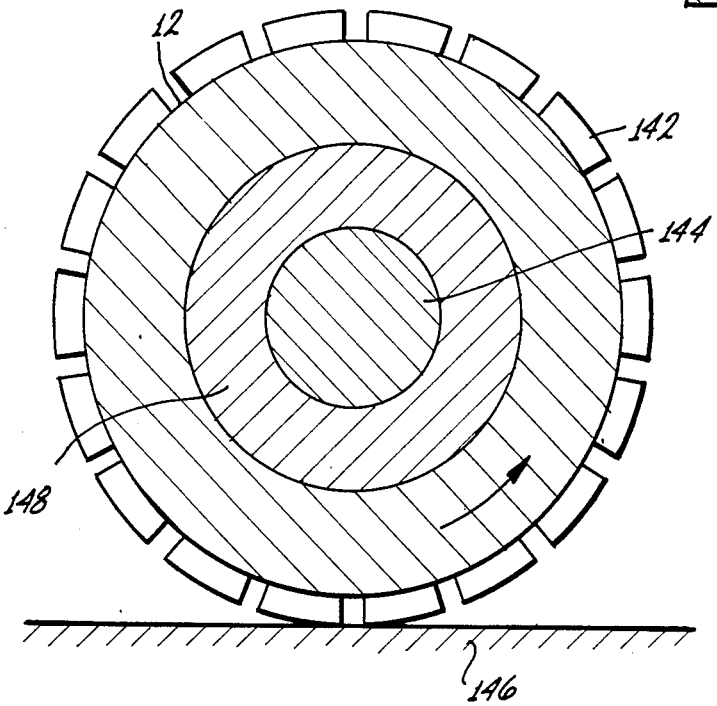
FIG. 8 is a cross sectional view of still another embodiment of a drill bit incorporating the invention.
Figure 9:
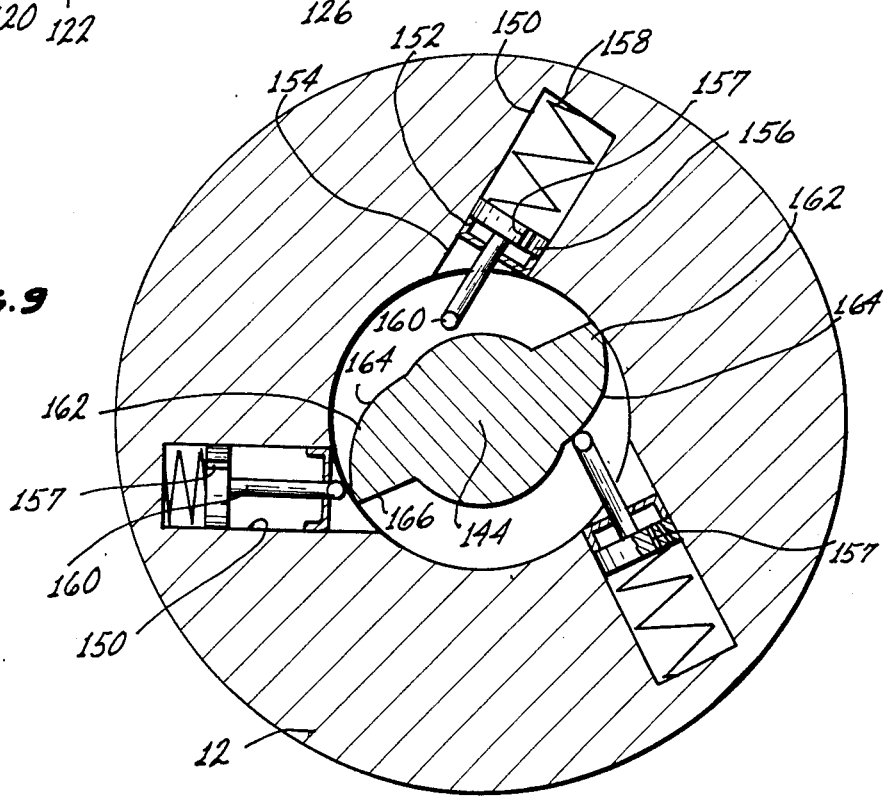
FIG. 9 is a braking mechanism as employed in combination with the embodiment of the invention depicted in FIG. 8.

Turn now to yet another embodiment of the invention as depicted in FIGS. 8 and 9. FIG. 8 is a cross-sectional view through carrier 12 in which the cutting elements 142 are slowly rotated about axis 144 of carrier 12. Cutting elements 142 are diagrammatically depicted as rectangular elements which may be considered as any cutting element known to the art such as diamond impregnated cutters 140 of the embodiment of FIG. 7 or as a plurality of radially disposed ribs on the exterior conical surface of carrier 12, each rib of which may carry drag cutters.

Carrier 12 advances to the left as depicted in FIG. 8 by virtue of rotation of bit 10. As bit 10 rotates, carrier 12 tends to rotate in a counter-clockwise direction by virtue of the drag between cutters 142 and a rock formation 146. However, carrier 12 is rotatably coupled to a fixed pivot shaft 144 by means of a stepping or rotating mechanism 148 which is symbolically depicted in FIG. 8 as a concentric cylindrical section between carrier 12 and pivot shaft 144.

The result is that carrier 12 will not rotate as fast as the overall rotation of the drill string would otherwise cause it to rotate. Therefore, cutting elements 142 will be drug across rock formation 146 thereby providing an even wear to each of the cutting elements regardless of its position on carrier 12. The life of the drill bit is thus extended by distributing the wear among a large number of cutting elements.

Turn now to FIG. 9 wherein one embodiment of the stepping or rotating mechanism 148 is explicitly illustrated in simplified cross-sectional view. Disposed within carrier 12 or intermediately within a cylindrical member coupled to carrier 12 is a plurality of hydraulic dash pots 150. Each dash pot is a closed, sealed, hydraulically filled cylinder defined in carrier 12. Dash pot 150, for example, is sealed at its inner most end by sealing cap 152 through which a reciprocating rod 154 is telescopically disposed. Rod 154 in turn is coupled to a piston 156 which is in a sealed relationship to the cylinder defined in carrier 12. Piston 156 has at least one small orifice 158 defined therethrough to permit bidirectional flow of hydraulic fluid through piston 156. Piston 156 and rod 154 are urged radially inward by means of a compression spring 158 disposed within the cylinder. One end of the compression spring 58 bears against the bottom or blind hole of the cylinder and the opposing end bears against piston 156.

Rod 154 is provided with a bearing end 160 which is arranged and configured for sliding contact with stationary pivot shaft 144. Pivot shaft 144 is provided with at least one and in the illustrated embodiment two opposing radially extending cammed portions 162. Cammed portions 162 are provided with a leading, smooth, rounded surface 164 and a flat trailing radial surface 166. As carrier 12 rotates about stationary pivot shaft 144, leading surface 164 will come into contact with end 160 of one of the plurality of dash pots 150. End 160 may simply be a rounded termination or may be comprised of a roller pivotally coupled to the end of rod 154 and rotatable about an axis parallel to the axis of pivot shaft 144. As carrier 12 continues to rotate in a counter-clockwise direction as depicted in FIG. 9, end 160 will ride up against leading surface 164 thereby compressing rod 154 and piston 156 into its respective cylinder against spring 158. Hydraulic fluid will dampen the compression and provide a measured degree of resistance, according to well known principles, dependent upon the viscosity of the hydraulic fluid within the dash pot and the number and nature of orifices 157 defined through piston 156.

After carrier 12 has rotated so that termination 126 is no longer in contact with leading surface 164, it will be free to expand across radial surface 166 and ultimately assume a fully extended position under the urging of spring 158 as carrier 12 continues to rotate bringing end 160 into contact with leading surface 164 of the opposing cammed portion 162 of pivot axis 144.

In the depiction of FIG. 9 three equally spaced dash pots 150 are shown in combination with two opposing cammed portions 162. Thus, at each point in the rotation of carrier 12, one of the three dash pots 150 will be undergoing compression and hence will apply a resistance to the rotation of carrier 12 with respect to fixed pivot axis 144. According to the invention, the number and arrangement of dash pots 150 in combination with cammed portions 122 of fixed shaft 144 can be arranged either to apply a continuous resistance to rotation or a stepped resistance to rotation as may be desired. A stepped resistance may be accomplished either by providing a combination of dash pots 150 with cammed portions 162 such that during a segment of rotation of carrier 12, no dash pot 150 is being operated. A continuous or substantially continuous resistance is created by providing a combination where, during certain segments of rotation of carrier 12, a multiple number of dash pots are engaged followed by a rotational segment in which a fewer number of dash pots are operatively engaged.

Many modifications and alterations may be made by those having ordinary skill in the art without departing from the spirit and scope of the invention. The illustrated embodiment has thus been set forth only as an example and should not be read as limiting the invention which is defined by the following claims.

We claim:

1. A drag bit in combination with a drill string arranged and configured to drill when rotated in a single predetermined direction comprising:

a bit body;

at least one carrier rotatably coupled to said bit body;

a plurality of cutting elements disposed on said carrier; and means for selectively rotating said carrier to selectively dispose said cutting elements into an operative configuration without rotating said drill string in any direction other than said predetermined direction, whereby cutting properties of said drag bit are selectively altered.

2. A drag bit comprising:

a bit body;

at least one carrier rotatably coupled to said bit body;

a plurality of cutting elements disposed on said carrier; and means for selectively rotating said carrier to selectively dispose said cutting elements into an operative configuration.

wherein said means for selectively rotating said carrier automatically rotates said carrier upon a predetermined degree of wear of selected ones of said cutting elements disposed on said carrier, whereby cutting properties of said drag bit are selectively altered.

3. The bit of claim 2 wherein said means for automatically selectively rotating said carrier comprises a gear engaged with said carrier, and gear coupled to and moveable with respect to said bit body, and means for selectively permitting movement of said gear relative to said bit body thereby in turn permitting selective rotation of said carrier.

4. The bit of claim 3 wherein said means for selectively permitting rotation of said gear relative to said bit body comprises:

a plurality of stops defined into said gear;

a corresponding plurality of selectively locked wedge elements, said wedge elements arranged and configured to abut said corresponding stops defined in said gear, said wedge elements preventing movement of said gear when locked in abutment with said corresponding stop, said wedge elements selectively unlockable to permit movement of said gear; and means for unlocking said wedge elements.

5. The bit of claim 4 wherein said means for unlocking said wedge elements comprises a hydraulic piston coupled to each of said wedge elements and a corresponding cylinder, said hydraulic piston telescopically disposed in said hydraulically filled corresponding cylinder, and a corresponding conduit communicating said hydraulically filled cylinder to a terminus at a predetermined position adjacent said cutting elements on said carrier, said terminus sealing said conduit thereby retaining fluid within said cylinder and maintaining said wedge element in a locked configuration, said terminus being worn away after a predetermined amount of wear of said cutting elements has occurred and exposed said terminus to wear against said rock formation, opening of said terminus on being worn away permitting escape of hydraulic fluid from said cylinder thereby unlocking said wedge from said gear.

6. A drag bit comprising:

a bit body;

at least one carrier rotatably coupled to said bit body;

a plurality of cutting elements disposed on said carrier; and means for selectively rotating said carrier to selectively dispose said cutting elements into an operative configuration, wherein said means for selectively rotating said carrier automatically rotates said carrier upon a predetermined degree of wear of selected ones of said cutting elements disposed on said carrier.

further comprising a plurality of carriers and wherein said means for selectively rotating said carrier comprises a selectively actuatable piston within said bit body, said piston having a aperture defined therethrough to normally permit flow of hydraulic fluid through said bit body and aperture, said aperture being selectively closable thereby causing hydraulic pressure to be exerted against said piston, a plurality of push rods coupled to said piston, and a corresponding plurality of cammed elements coupled to said plurality of carriers and rotatable therewith, said cammed elements each including at least one cam surface for engagement with the corresponding one of said push rods whereby movement of said corresponding one of said push rods rotates said cammed element and hence said corresponding carrier through a predetermined angular degree of rotation, whereby cutting properties of said drag bit are selectively altered.

7. The bit of claim 6 wherein said cammed element is rotatable in only one direction to thereby permit replacement of a first set of cutting elements by a second set of said cutting elements.

8. A drag bit comprising:

a bit body;

at least one carrier rotatably coupled to said bit body;

a plurality of cutting elements disposed on said carrier; and means for selectively rotating said carrier to selectively dispose said cutting elements into an operative configuration, wherein said means for selectively rotating said carrier automatically rotates said carrier upon a predetermined degree of wear of selected ones of said cutting elements disposed on said carrier, wherein a conduit is disposed through said carrier to a terminus adjacent selected ones of said cutting elements, said conduit fluidically communicating with a primary hydraulic flow through said bit body, said terminus being selectively opened after a predetermined degree of wear has occurred with respect to the corresponding cutting elements on said carrier adjacent to said terminus of said conduit, hydraulic pressure being relieved through said conduit from said bit body, said relief of pressure being observable by said operator, whereby cutting properties of said drag bit are selectively altered.

9. A drag bit comprising:

a bit body;

at least one carrier rotatably coupled to said bit body;

a plurality of cutting elements disposed on said carrier; and means for selectively rotating said carrier to selectively dispose said cutting elements into an operative configuration, wherein said means for selectively rotating said carrier automatically rotates said carrier upon a predetermined degree of wear of selected ones of said cutting elements disposed on said carrier, wherein said means for selectively rotating said carrier comprises a gear wheel engaging said carrier, said gear wheel being selectively locked and unlocked to permit rotation of said gear wheel and thus said carrier by said operator initiated action, whereby cutting properites of said drag bit are selectively altered.

10. A drag bit comprising:

a bit body;

at least one carrier rotatably coupled to said bit body;

a plurality of cutting elements disposed on said carrier; and means for selectively rotating said carrier to selectively dispose said cutting elements into an operative configuration, wherein said means for selectively rotating said carrier rotates said carrier at a reduced rate thereby dragging said cutting elements against said rock formation, whereby cutting properties of said drag bit are selectively altered.

11. The bit of claim 10 wherein said means for selectively rotating said carrier comprises means for generating a stepwise drag on rotation of said carrier.

12. The bit of claim 11 wherein said means for applying a stepwise drag to said carrier comprises a plurality of dash pots disposed within said carrier and a fixed pivot pin disposed within said carrier, said carrier rotating about said fixed pivot pin, said fixed pivot pin being fixed to said bit body, said pivot pin comprising a plurality of cammed portions, said cammed portions selectively engaging said dash pots during selected rotational segments of said carrier about said pivot pin.

13. The bit of claim 10 wherein said means for selectively rotating said carrier comprises means for continuously applying a rotational drag to said carrier.

14. The bit of claim 13 wherein said means for applying a drag to said carrier comprises a plurality of dash pots disposed within said carrier and a fixed pivot pin disposed within said carrier, said carrier rotating about said fixed pivot pin, said fixed pivot pin being fixed to said bit body, said pivot pin comprising a plurality of cammed portions, said cammed portions selectively engaging said dash pots during selected rotational segments of said carrier about said pivot pin wherein at each angular position of said carrier about said pivot pin at least one dash pot is engaged so that a drag is continuously applied.

15. An improvement is a roller cone bit in combination with a drill string for cutting a rock formation said drill string arranged and configured to drill when rotated in a single predetermined direction, said roller cone bit comprising a plurality of roller cones, said improvement comprising:

a plurality of sets of drag cutters disposed on each one of said plurality of roller cones; and means for selectively preventing rotation of each roller cone to present selected ones of said sets of drag cutters to said rock formation for cutting without rotating said drill string in a direction opposite to said predetermined direction, whereby cutting performance of said roller cone bit as a drag bit is selectively alterable.

16. The improvement of claim 15 wherein said means for selectively preventing rotation of said roller cones comprises means for first permitting rotation of said roller cone through a predetermined angular degree to present a second one of said plurality of said drag cutters to said rock formation in an operative cutting configuration and means for subsequently preventing further rotation of said roller cone.

17. The improvement of claim 16 further comprising means for selectively initiating operation of said means for first permitting rotation and selectively initiating said means for subsequently preventing rotation of said roller cone after a predetermined degree of wear of a corresponding selected one of said plurality of set of drag cutters has occurred.

18. The improvement of claim 17 wherein said means for selectively initiating operation initiates said operation automatically without operator intervention upon occurrence of said predetermined degree of wear.

19. An improvement in a roller cone bit for cutting a rock formation, said roller cone bit comprising a plurality of roller cones, said improvement comprising:

a plurality of sets of drag cutters disposed on each one of said plurality of roller cones; and means for selectively preventing rotation of each roller cone to present selected ones of said sets of drag cutters to said rock formation for cutting, wherein said means for selectively preventing rotation comprises means for applying a rotational drag upon each roller cone thereby sequentially exposing each of said plurality of drag cutters on said roller cone to said rock formation and evenly distributing wear among all of said drag cutters, whereby cutting performance of said roller cone bit as a drag bit is selectively alterable.

20. In a drill string adapted to drill in a single direction or rotation, a method for selectively presenting ones of a plurality of sets of drag cutters for cutting into a rock formation, said drag cutters disposed on roller cones of a roller cone bit, said roller cones being generally free to rotate with rotation of said roller cone bit, said method comprising the steps of:

rotating said roller cone bit; and selectively preventing rotation of each roller cone of said bit to dispose selected sets of said plurality of drag cutters to said rock formation for cutting, without rotating said drill string in the direction opposite to said single direction.

21. In a drill string adapted to drill in a single direction of rotation, a method for selectively presenting ones of a plurality of sets of drag cutters for cutting into a rock formation, said drag cutters disposed on roller cones of a roller cone bit, said roller cones being generally free to rotate with rotation of said roller cone bit, said method comprising the steps of:

rotating said roller cone bit; and selectively allowing rotation of each roller cone to operatively present selected ones of said plurality of sets of drag cutters to said rock formation for cutting without rotating said drill string in the direction opposite to said single direction.

* * * * *